US007457576B2

(12) United States Patent
Takada et al.

(10) Patent No.: US 7,457,576 B2
(45) Date of Patent: Nov. 25, 2008

(54) IMAGE HEATING APPARATUS

(75) Inventors: Shigeaki Takada, Kashiwa (JP); Makoto Jinzai, Abiko (JP); Kazuhiro Hasegawa, Toride (JP); Ikuo Nakamoto, Toride (JP); Yasuhiro Hayashi, Moriya (JP); Daigo Matsuura, Toride (JP); Keigo Kaji, Abiko (JP); Hiroshi Komiyama, Kashiwa (JP); Nobuaki Hara, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 319 days.

(21) Appl. No.: 11/530,225

(22) Filed: Sep. 8, 2006

(65) Prior Publication Data

US 2007/0059065 A1 Mar. 15, 2007

(30) Foreign Application Priority Data

Sep. 13, 2005 (JP) ..... 2005-265873

(51) Int. Cl.
*G03G 15/20* (2006.01)

(52) U.S. Cl. ..... 399/329

(58) Field of Classification Search ..... 399/328, 399/329; 219/216, 469–471
See application file for complete search history.

(56) References Cited

U.S. PATENT DOCUMENTS 5,927,189 A * 7/1999 Jones et al. ..... 399/329
7,136,615 B2 * 11/2006 Oohara et al. ..... 399/329
7,200,354 B2 4/2007 Nakamoto et al. ..... 399/329
7,379,697 B2 * 5/2008 Ito et al. ..... 399/329
2005/0271408 A1 12/2005 Hayashi ..... 399/70
2005/0271433 A1 12/2005 Ono et al. ..... 399/329
2006/0127142 A1 6/2006 Nakamoto et al. ..... 399/329
2006/0171749 A1 * 8/2006 Tomita et al. ..... 399/329
2007/0127958 A1 6/2007 Matsuura et al. ..... 399/328
2007/0140760 A1 6/2007 Nakamoto et al. ..... 399/329
2007/0223979 A1 9/2007 Jinzai et al. ..... 399/333
2007/0231026 A1 10/2007 Hayashi et al. ..... 399/329
2008/0003028 A1 * 1/2008 Kuroki et al. ..... 399/329

FOREIGN PATENT DOCUMENTS

JP 2002-148970 5/2002
JP 2004-341346 12/2004

* cited by examiner

*Primary Examiner*—Susan S Lee
(74) *Attorney, Agent, or Firm*—Fitzpatrick, Cella, Harper & Scinto

(57) ABSTRACT

An image heating apparatus includes a first belt contactable to an image on a recording material to heat the image; a second belt for forming a nip with the first belt; a first pressing pad for pressing the first belt in the nip; a second pressing pad for pressing the second belt toward the first pressing pad, wherein the first pressing pad has a surface roughness Rz of not more than 20 μm, and the second pressing pad has a surface roughness Rz of 50-300 μm.

5 Claims, 4 Drawing Sheets

IMAGE HEATING APPARATUS

FIELD OF THE INVENTION AND RELATED ART

The present invention relates to an image heating apparatus for heating an image formed on a recording material. Examples of the image heating apparatus include a fixing device for fixing an unfixed image on the recording material and a glossiness improvement apparatus for re-heating the fixed image on the recording material. Such a fixing device and/or a glossiness improvement apparatus are usable with an image forming apparatus such as a copying machine, a printer or a facsimile machine.

In an image forming apparatus such as an electrophotographic apparatus or an electrostatic recording apparatus, a toner image is formed on a recording material (sheet) and is heated and pressed so that it is fixed. As for the fixing device, a roller fixing type is known in which a pressing roller is pressed against a fixing roller containing a heater therein to form a fixing nip.

In order to increase the speed of image formation or raising the glossiness, it is preferable to increase the time duration of fixing nip passing of the recording material to sufficiently melt the toner. In the case of the roller fixing type, this necessitates increase of the roller diameter with the result of upsizing of the fixing device.

Japanese Laid-open Patent Application 2004-341346 discloses a twin belt fixing type with which the apparatus is downsized, and the operation speed is increased, and in addition, the nip width (length in the sheet feeding direction) is sufficient.

In the apparatus disclosed in this Japanese Laid-open Patent Application, there are provided a fixing belt and a pressing belt which are opposed to each other to form a nip through which a sheet is passed to fix the image. By doing so, a sufficient nip width is provided as compared with conventional devices.

On the other hand, there is proposed a fixing device using a fixing roller and a pressing belt (Japanese Laid-open Patent Application 2002-148970). In the apparatus disclosed in the Japanese Laid-open Patent Application, there are provided a pressing pad and a low friction sheet on the surface of the pressing pad, wherein the pressing pad has been subjected to an emboss process, thus reducing the force required for rotating the pressing belt.

In a twin belt fixing type structure accomplished by the inventors, both of the belts are nipped by the fixing pad and the pressing pad to form a fixing nip. With such a structure, it is also important to reduce the force required for rotating the belts.

The inventors has accomplished a twin belt fixing type apparatus in which the use is made with the low friction sheet having been subjected to the emboss process is used for each of the fixing pad and the pressing pad, and has found the following problem.

Non-uniformness arises in the pressure in the fixing nip due to the emboss structures of the low friction sheets, with the result of appearance of stripes by the different glossiness. Thus, the image quality on the recording material is deteriorated.

SUMMARY OF THE INVENTION

Accordingly, it is a principal object of the present invention to provide an image heating apparatus in which forces required for rotating a first belt and a second belt are reduced, and in addition, the occurrence of the image heating defect can be suppressed.

While the invention has been described with reference to the structures disclosed herein, it is not confined to the details set forth, and this application is intended to cover such modification or changes as may come within the purposes of the improvements or the scope of the following claims.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The Embodiments of the present invention will be described in detail in conjunction with the accompanying drawings.

Embodiment 1

Figure 4:
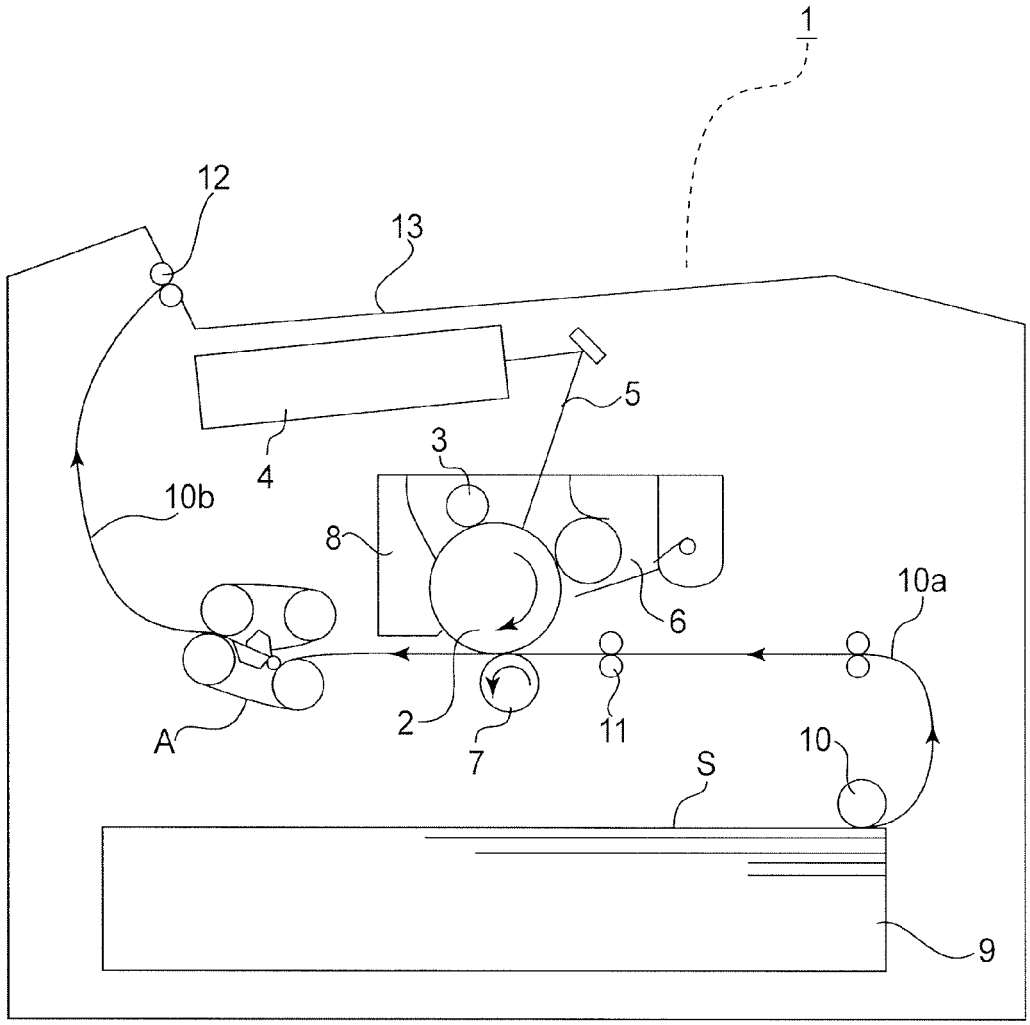
FIG. 4 is a schematic view of an example of image forming apparatus.

(1) Image Forming Station:

FIG. 4 is a schematic sectional view illustrating structures of a fixing device A which is an example of an image forming apparatus according to an embodiment of the present invention.

The image forming apparatus 1 of this example is an electrophotographic type laser beam printer comprising a photosensitive drum 2 (image bearing member) for bearing a latent image. The photosensitive drum 2 is rotated at a predetermined speed in the clockwise direction indicated by an arrow, and the outer surface thereof is electrically charged by a charger 3 to a uniform predetermined potential of the predetermined polarity. The uniformly charged surface is exposed to laser scanning exposure light 5 modulated in accordance with image information by a laser scanner (optical apparatus) 4. By this, an electrostatic latent image corresponding to the image information is formed on the surface of the photosensitive drum 2. The electrostatic latent image is developed by a developing device 6 into a toner image. The toner image is sequentially transferred onto a recording material (sheet) S introduced into a transfer portion where the transfer roller 7 is contacted to the photosensitive drum 2.

The recording material S is stacked in a sheet feeding cassette 9 disposed at a lower portion of the apparatus. A sheet feeding roller 10 is actuated at predetermined sheet feeding timing, by which one recording material in the sheet feeding cassette 9 is picked up and is fed to the pair of registration rollers 11 by way of a feeding path 10*a*. The registration rollers 11 function to be abutted by the leading-edge of the recording material S, and thus correcting the obliqueness of the recording material. The registration rollers 11 further functions to feed the recording material S so that when the leading end of the image portion on the photosensitive drum reaches the transfer portion, the leading end of the recording material also reaches the transfer portion.

The recording material S having passed through the transfer portion is separated from the surface of the photosensitive drum 2 and is conveyed into the fixing device A. The fixing device A functions to fix the unfixed toner image on the recording material S into a permanent fixed image by heat and pressure. The recording material is then discharged and stacked on a discharging tray 13 provided at an upper portion of the apparatus by a pair of discharging rollers 12 by way of a feeding path 10*b*.

The surface of the photosensitive drum 2 after the separation of the recording material is cleaned by a cleaning device 8 so that untransferred toner or the like is removed from the surface, and the photosensitive drum 2 is prepared for repetitive image formation.

Figure 1:
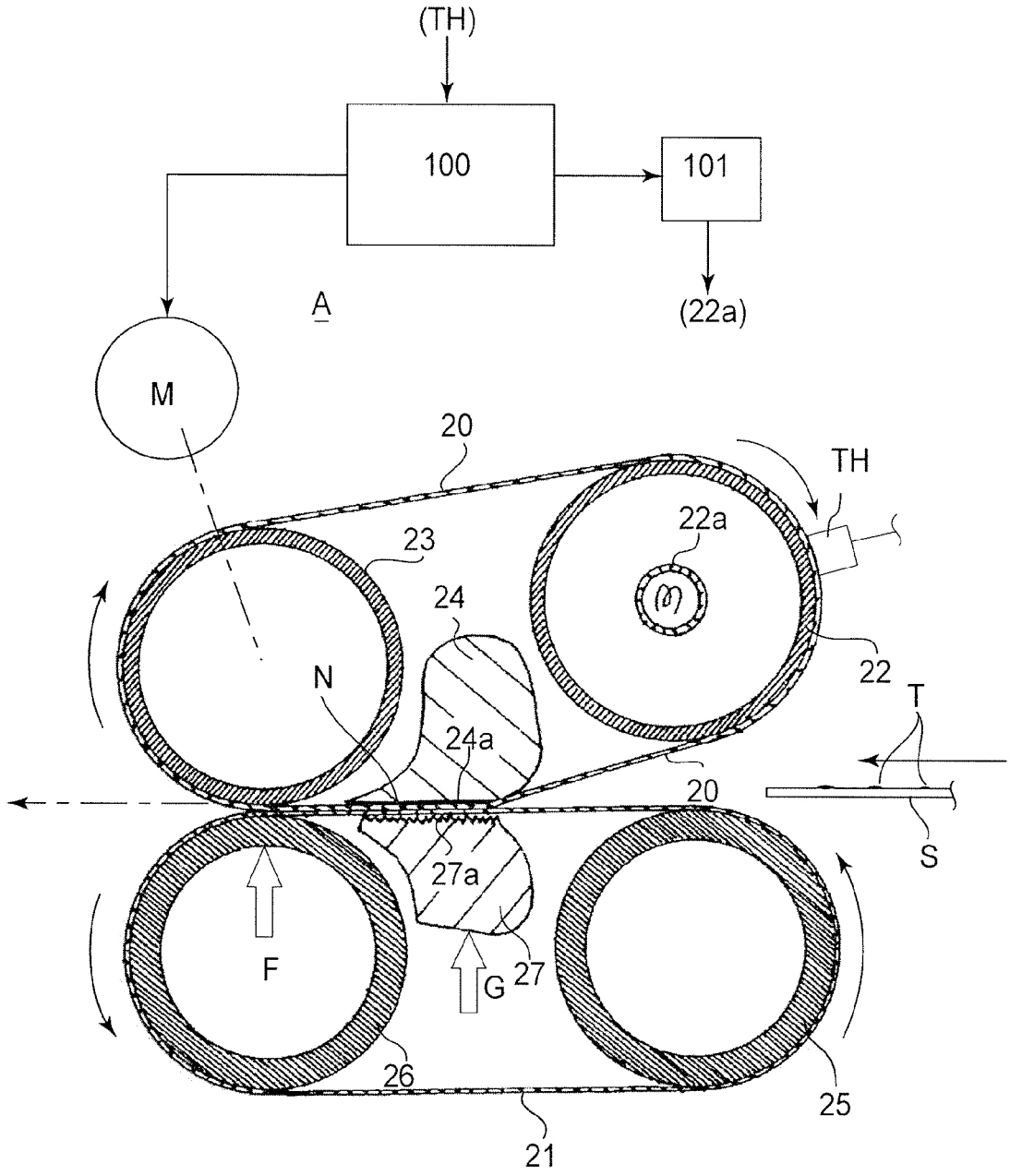
FIG. 1 is a schematic sectional view of a major part of a fixing device according to a first embodiment of the present invention.

(2) Fixing Device A:

FIG. 1 is a schematic sectional view of a major part of a fixing device A which is an example of the image heating apparatus. The "longitudinal" or "longitudinal direction" with respect to the fixing device A or the structures constituting the fixing device A is the direction parallel to the direction perpendicular to the feeding direction of the recording material in the plane of the recording material feeding path. The "front side" of the fixing device is the side at which the recording material enters. The "left and right" mean "left and right" as seen from the front side of the apparatus. The "width of the belt" is the dimension of the belt measured in the direction perpendicular to the recording material feeding direction, that is, the dimension of the belt measured in the longitudinal direction. The "width" of the recording material is the dimension of the recording material measured in the direction perpendicular to the recording material feeding direction in the plane of the recording material. The "upstream and downstream" are upstream and downstream with respect to the feeding direction of the recording material.

The fixing device A comprises a fixing belt (fixing means) 20 in the form of a first endless belt and a pressing belt (pressing means) 21 in the form of a second endless belt.

The fixing belt 20 includes a base layer of polyimide resin material having an inner diameter of 40 mm and a thickness of 75 μm and an elastic layer on the outer peripheral surface of the base layer, the elastic layer having a thickness of 750 μm. The material of the elastic layer may be any known elastic material, such as silicone rubber, fluorine rubber or the like. In this embodiment, the use is made with silicone rubber having a hardness of JIS-A 20° and a thermal conductivity of 0.8 W/mK.

The thickness of the elastic layer is preferably not less than 100 μm from the standpoint of avoiding uneven glossiness which may be caused by incapability of the heating surface in conforming to the pits and projections of the toner layer or the recording material in the printing operation. If the thickness of the elastic layer is less than 100 μm, the function of the elastic member is not sufficient with the result of non-uniformity pressure distribution during the fixing operation. Particularly in the case of the full-color image fixing, the unfixed toner of the secondary color is not sufficiently fixed, and therefore, the glossiness of the fixed image may be uneven. In addition, insufficient melting of the toner results in poor color mixture property so that high precision full-color image cannot be provided.

By deformation of the elastic layer, then sheet is prevented from wrapping around the fixing belt 20 and is properly separated therefrom.

In addition, on the outer periphery of the elastic layer, there is provided a surface parting layer, that is, fluorinated resin material layer such as PFA or PTFE having a thickness of 30 μm.

With such a structure, the total thickness of the fixing belt 20 is 855 μm. The thickness of the elastic layer is preferably not less than 100 μm in terms of the fixing property. Therefore, the total thickness of the fixing belt is preferably not less than 200 μm when the thickness of the base resin material and the thickness of the surface parting layer are taken into account. On the other hand, a large thickness of the elastic layer means a large thermal capacity with the result of longer time required to warm the fixing belt up, and therefore, the thickness of the elastic layer is preferably not more than 1400 μm. Therefore, in consideration of the thickness of the base resin material and the thickness of the surface parting layer, the total thickness of the fixing belt is preferably not more than 1500 μm. In other words, the thickness of the fixing belt is preferably 200-1500 μm.

The pressing belt 21 comprises a base layer of polyimide having an inner diameter of 40 mm and a thickness of 75 μm and a parting layer of fluorinated resin material (PFA) tube having a thickness of 30 μm.

The fixing belt 20 is stretched around the heating roller 22 and the fixing roller 23 which function as belt stretching members. The heating roller 22 and the fixing roller 23 are rotatably supported by bearings between left and right side plates, not shown, of the apparatus.

The heating roller 22 comprises a hollow roller of steel having an outer diameter of 20 mm, an inner diameter of 18 mm and a thickness of 1 mm, and it contains a halogen heater 22*a* functioning as heating means. The heating roller 22 has a function of a tension roller for stretching the fixing belt 20.

The fixing roller 23 comprises a core metal of ferro-alloy having an outer diameter of 20 mm and a diameter of 18 mm and an elastic layer in the form of a silicone rubber layer. The fixing roller 23 is therefore an elastic roller having a high sliding property. The fixing roller 23 is supplied with a driving force through an unshown driving gear train from a driving source (motor) M and is rotated in the clockwise direction indicated by an arrow at a predetermined speed. By the provision of the elastic layer in the fixing roller 13, the driving force inputted to the fixing roller 13 can be effectively transmitted to the fixing belt 20, and in addition, the recording material can be properly separated from the recording material at the fixing nip. The hardness of the silicone rubber is JIS-A 15°, and thermal conductivity thereof is 0.8 W/mK. The provision of the silicone rubber layer is effective to reduce the heat conduction to the inside, and therefore, the time required for the warming-up can be reduced.

When the fixing roller 23 is rotated, the fixing belt 20 rotates together with the fixing roller 23 by the friction between the silicone rubber surface of the fixing roller 23 and the inner surface polyimide layer of the fixing belt 20.

The pressing belt 21 is stretched around the tension roller 25 and the pressing roller 26 which function as belt stretching members. The tension roller 25 and the pressing roller 26 are rotatably supported by bearings between unshown left and right side plates of the apparatus.

The tension roller 25 comprises a core metal of ferro-alloy having an outer diameter of 20 mm and a diameter of 16 mm and a silicone sponge layer thereon, the silicone sponge layer having a low thermal conductivity and therefore being effective to reduce the heat conduction from the pressing belt 21.

The pressing roller 26 comprises a low sliding property rigid roller of ferro-alloy having an outer diameter of 20 mm, an inner diameter of 16 mm and a thickness of 2 mm.

In order to form a fixing nip N (image heating nip) between the fixing belt 20 and the pressing belt 21, the pressing roller 26 is pressed against the fixing roller 23 with predetermined pressure in the direction indicated by an arrow F by an unshown pressing mechanism at each of the left and right end portions of the rotation shafts.

In this embodiment, the apparatus is a twin belt type, and a fixing pad and a pressing pad are employed to form a wide fixing nip N (long in the recording material feeding direction). The fixing pad 24 (first pressing pad) presses the fixing belt 20 against the pressing belt 21, and the pressing pad 27 (second pressing pad) presses the pressing belt 21 against the fixing belt 20. More particularly, the fixing belt and the pressing belt are sandwiched between the pressing pad and the fixing belt to provide a fixing nip.

The fixing pad 24 and the pressing pad 27 are supported by the unshown left and right side plates of the apparatus. The pressing pad 27 is pressed to the fixing pad 24 with a predetermined pressure in direction indicated by an arrow G by an unshown pressing mechanism.

There is provided a control circuit portion 100 (control means) which drives a motor M (driving means) at least during the image formation execution. By this, the fixing roller 23 is rotated, and the fixing belt 20 is rotated in the same direction. The peripheral speed of the fixing belt 20 is slightly smaller than the feeding speed of the sheet S fed from the image forming station side for the purpose of looping the recording material.

The pressing belt 21 is driven by the fixing belt 20. Here, at the downstreammost part of the fixing nip, the fixing belt 20 and the pressing belt 21 are nipped by the rollers 23, 26 so that slippage of the belt can be prevented. At the downstreammost part of the fixing nip, the pressure provided by the fixing nip is maximum in the pressure distribution in the fixing nip with respect to the feeding direction of the recording material.

In this embodiment, the peripheral speed of the fixing belt 20 is 300 mm/sec, and therefore, 70 sheets (A4 size) of full-color images can be fixed per min.

The control circuit portion 100 (control means) supplies the electric power to the halogen heater 22*a* (heating means) from a voltage source circuit 101. By this, the heating roller 22 is heated. The heating roller 22 heats the rotating fixing belt 20. The surface temperature of the fixing belt 20 is detected by a thermister or the like (temperature detecting element) TH. A signal indicative of the temperature of the fixing belt 20 detected by the temperature detecting element TH is fed to the control circuit portion 100. The control circuit portion 100 controls the electric power supply to the halogen heater 22*a* from the voltage source circuit 101 so that temperature information supplied from the temperature detecting element TH is maintained at the predetermined fixing temperature.

In the state that temperature of the fixing belt 20 is raised to the predetermined fixing temperature and is controlled at the temperature, the recording material S carrying the unfixed toner image T is fed into the fixing nip N between the fixing belt 20 and the pressing belt 21. The recording material S is introduced with the unfixed toner image carrying side facing up. The recording material S is nipped and fed with the unfixed toner image T in close contact with the outer surface of the fixing belt 20, so that heat and pressure are applied from the fixing belt 20, by which the unfixed toner image is fixed on the surface of the recording material S.

The fixing roller 23 in the fixing belt 20 is an elastic roller having a rubber layer, and the pressing roller 26 in the pressing belt 21 is a rigid roller of ferro-alloy, and therefore, the deformation of the fixing roller 23 is large at the fixing nip outlet. As a result, the fixing belt 20 also largely deforms, and the recording material S carrying the toner image is separated from the fixing belt 20 by the curvature and the rigidity of the recording material S itself.

In this embodiment, the fixing pad 24 (first pressing pad) is made of resin material, more particularly, PPS (polyphenylenesulfide resin material resin material). The surface roughness Rz of the surface 24*a* of the fixing pad 24 which is contacted to the inner surface of the fixing belt is not more than 20 μm in this embodiment. The surface is therefore a smooth surface in this embodiment. This is because if the contact surfaces between the fixing pad 24 and the fixing belt are not smooth, the pressure distribution in the fixing nip is not uniform with the result of non-uniform-glossiness stripe on the image.

The second pressing pad (the pressing pad 27) is made of resin material, more particularly, PPS resin material (polyphenylenesulfide resin material resin material). The surface roughness Rz of the surface 27*a* of the pressing pad 27 which is contacted to the inner surface of the pressing belt is not less than 50 μm and not more than 300 μm. In this embodiment, the surface roughness Rz is 100 μm.

When the nip is formed using pads which are not rotatable members, the inner surface of the belt slides on the pad, and if the friction coefficient between the pad and the inner surface of the belt is large, the sliding resistance is large. As a result of, an image deviation, gear damage, an electric energy consumption increase of the driving motor may occur. This problem is remarkable when the upper and lower belt type is used to form the fixing nip N with the pads.

In this embodiment, the surface roughness of the surface 27*a* of the pressing pad 27 which is contacted to the inner surface of the pressing belt Rz is 100 μm, the contact area between the pressing pad 27 and the inner surface of the pressing belt is small so that sliding resistance is small. When the unsmoothness of the pressing pad 27 is large, the pressure distribution in the nip is not uniform, but there is a recording material between the pressing pad 27 and the image surface, and therefore, the pressure distribution does not easily affect the resultant image.

The average interval Sm between adjacent peaks on the belt contact surface of the pressing pad 27 is preferably not less than 250 μm and not more than 3000 μm. If Sm is less than 250 μm, the interval between the peaks is so small that surface is smooth in effect. If, on the other hand, Sm exceeds 3000 μm, intervals between one peak and another peak is so large that contact areas around the peaks are large, with the result that contact area as a whole is large.

As described in the foregoing, the surface of the fixing pad which is nearer to the image, and therefore, which is relatively more influential to the image is smooth surface from the standpoint of image quality. On the other hand, the surface of the pressing pad which is remote from the image by the thickness of the recording material, and therefore, which is relatively less influential to the image is made unsmooth from the standpoint of sliding property. By doing so, the force required for rotational drive of the fixing belt and the pressing belt is reduced as much as possible, while preventing the non-uniform-glossiness stripe from appearing on the image.

Embodiment 2

Figure 2:
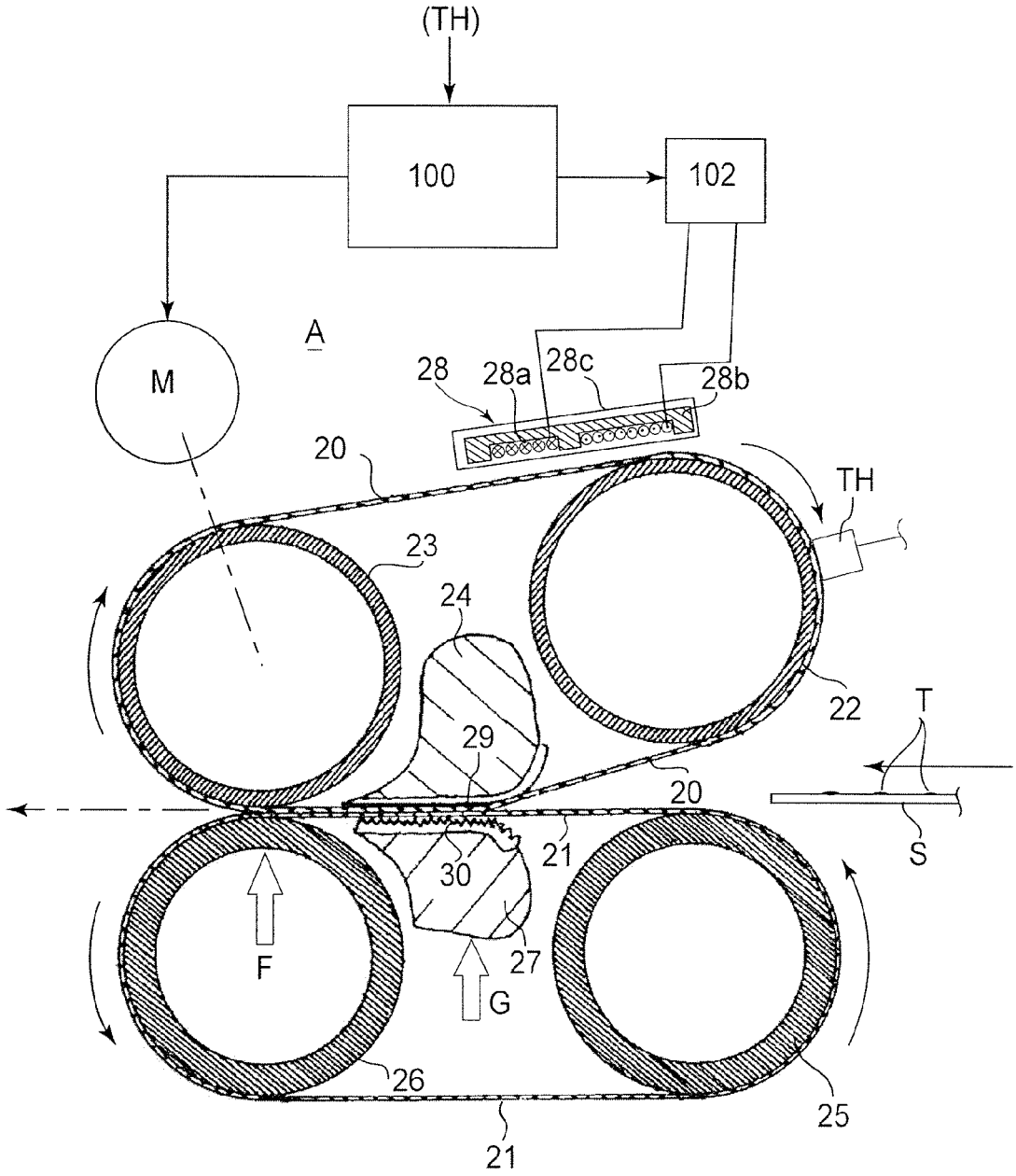
FIG. 2 is a schematic sectional view of a major part of a fixing device according to a second embodiment of the present invention.

FIG. 2 is a schematic sectional view of a major part of the fixing device A according to Embodiment 2 of the present invention. In this embodiment, an electromagnetic induction heating type heating source (induction heating member, excitation coil or the like) exhibiting a high energy efficiency, is used as the heating means for the fixing belt 20. Induction heating member 28 comprises an induction coil 28*a*, an excitation core 28*b* and a coil holder 28*c* holding them. The induction coil 28*a* comprises a litz wire and is a flat oval coil which is disposed in recesses of an excitation core 28*b* having a horizontal E-shape cross-section. The excitation core 28*b* is made of ferrite, permalloy or the like which has a high magnetic permeability and a low remanent flux density, and therefore, the loss by the induction coil 28*a* and the excitation core 28*b* can be suppressed, so that fixing belt 20 can be efficiently heated.

Since the base layer of the fixing belt 20 of the embodiment is heated by the induction heating member 28, it is a metal layer of SUS alloy, nickel, iron, magnetic stainless steel, cobalt-nickel alloy or the like. In this embodiment, it comprises a metal layer of nickel, as the base layer, which is in the form of a thin film having an inner diameter of 40 mm and a thickness of 250 μm. The thickness is preferably 1-300 μm. If the thickness of the base layer is smaller than 1 μm, the rigidity is too low, with the result that it is not durable against a great number of heating operations. If, on the other hand, the thickness of the base layer exceeds 300 μm, the rigidity is too high, and the flexibility is not enough to be a rotatable member. The outer periphery of the base layer is coated with an elastic layer of silicone rubber having a thickness of 750 μm. On the outer periphery of the elastic layer, there is provided a surface parting layer, that is, fluorinated resin material layer such as PFA or PTFE having a thickness of 30 μm.

When a high frequency current flows from the excitation circuit 102 to the induction coil 28*a* of the induction heating member 28, the induction heat generation occurs in the metal layer of the fixing belt 20 to heat the fixing belt 20. The surface temperature of the fixing belt 20 is detected by a thermister or the like (temperature detecting element) TH. A signal indicative of the temperature of the fixing belt 20 detected by the temperature detecting element TH is fed to the control circuit portion 100. The control circuit portion 100 controls the electric power supply to the induction coil 28*a* from the excitation circuit 102 so as to maintain the temperature information inputted from the temperature detecting element TH at a predetermined fixing temperature, thus keeping the temperature of the fixing belt 20 at the predetermined fixing temperature.

In this embodiment, the pressing belt 21 has exactly the same structure as the fixing belt 20. This is done in order to enhance the durable of the pressing belt by the base layer (metal layer) which exhibits a high anti-wearing property.

The structures of the heating roller 22, the fixing roller 23, the tension roller 25 and the pressing roller 26 are the same as with the first embodiment.

In this embodiment, the fixing pad 24 (first pressing pad) comprises a pad base member and a sliding sheet (low friction sheet) 29 which is in contact with the belt. The pressing pad 27 (second pressing pad) similarly comprises a pad base member and a sliding sheet 30 which is in contact with the belt.

This is because if the belt base layer is a metal layer, a problem of scraping of the sliding surface of the pad relative to the inner surface of the belt by the belt base layer arises. By the interposition of the sliding sheets 29 and 30 between the belt and the pad base member, the scraping of the pad is prevented, and the sliding resistance can be reduced, and therefore, the belt travelling property and the belt durability can be assured.

More particularly, the sliding sheet 29 of the fixing pad 24 comprising a base layer of polyimide having a thickness of 50 μm and a base layer in the form of a fluorinated resin material layer of PFA or PTFE, or the like having a thickness of 25 μm. The material of the base layer may be any that exhibit enough heat resistance and wearing resistance, and may be for example polyimide, polyetherimide PES, PFA (4 fluorinatedethylene-perfluoroalkylvinylether copolymer resin material). The surface roughness Rz of the surface of the sliding sheet 29, contacting to the belt is not more than 20 μm. The surface is therefore a smooth surface in this embodiment. Non-uniformness arises in the pressure in the nip due to the unsmoothness of the belt-contacting surface of the sliding sheet 29, with the result of appearance of stripes by the different glossiness.

The sliding sheet 30 of the pressing pad 27 comprises a base layer of polyimide having a thickness of 50 μm and a surface parting layer in the form of a fluorinated resin material layer (PFA, PTFE or the like) having a thickness of 25 μm. The surface roughness Rz of the surface of the sliding sheet 30 which contact the belt is not less than 50 μm and not more than 300 μm. In this embodiment, it is processed by embossing treatment to provide a surface roughness Rz of approx. 150 μm. By doing so, the contact area between the pressing belt 21 and the pressing pad 27 is made small, so that sliding resistance can be reduced. If the sliding sheet 30 has deep unsmoothness, the non-uniformity in the pressure in the nip is enhanced, but there is a recording material between itself and the image surface, and therefore, the influence of the non-uniformity in the pressure is not significant.

The average interval Sm between adjacent peaks on the belt-contacting surface of the sliding sheet 30 is preferably not less than 250 μm and not more than 3000 μm.

As described in the foregoing, also when the base layer of the belt 20, 21 is a metal layer, the fixing pad 24 (first pressing pad) comprises the pad base member and the sliding sheet (low friction sheet) 29 contacted to the belt. Additionally, the pressing pad 27 (second pressing pad) comprises the pad base member and the sliding sheet 30 contacted to the belt. By doing so, the pad scraping attributable to the sliding relative to the belt can be prevented, and the sliding resistance can be reduced, so that travelling property and durability of the belt is improved. Furthermore, the sliding sheet 29 which is relatively more influential to the image is made a smooth surface in consideration of the image property. The surface of the pressing pad which is less influential to the image is much less smooth in consideration of the sliding property, so that while a wide fixing nip is used, the sliding resistance is reduced, and the non-uniform-glossiness stripe is prevented from appearing on the resultant image.

Embodiment 3

In this embodiment, the elastic layer of the fixing belt 20 has a thickness of 300 μm. The structures of this embodiment are the same as those of Embodiment 2.

When the thickness of the elastic layer of the fixing belt 20 is large, the thermo-conductivity for the fixing operation is low with the result of poor heat followability of the fixing surface, which deteriorates the quick start property and also foster the tendency of non-uniform fixing property. Particularly, since the fixing belt 20 is opposed to the image on the recording material, the thickness of the elastic layer of the fixing belt 20 is preferably not more than 500 μm in consideration of the quick start property, the prevention of the fixing non-uniformity. However, if the thickness of the elastic layer of the fixing belt 20 is too small, it is difficult to smooth out the pressure unevenness with the result of tendency of the influence of the surface property of the pad or the like to which the inner surface of the belt contacted. For example, when the fixing sliding sheet 29 is processed by an emboss treatment, the pressure unevenness tends to occur, and therefore, the non-uniform-glossiness stripe tends to appear on the resultant image. However, according to the embodiment, deep unsmoothness is provided on the surface of the pressing sliding sheet 30 which is contacted to the inner surface of the belt, by which the sliding resistance is reduced. And, since the surface of the fixing sliding sheet 30 which is contacted to the inner surface of the belt is smooth, the non-uniform-glossiness stripe is not produced even if the thickness of the elastic layer of the fixing belt 20 is reduced.

Accordingly, while the appearance of the non-uniform-glossiness stripe on the image is prevented, a satisfactory belt travelling property and high belt durability can be provided, and in addition, the thickness of the elastic layer of the fixing belt 20 can be reduced, and therefore, the fixing non-uniformity can be avoided while assuring the quick start property.

Embodiment 4

The structure of the apparatus of this embodiment is similar to those of Embodiment 2 and Embodiment 3, but is different from them in that thickness of the metal layer of the fixing belt is 50 μm and that thickness of the elastic layer is 300 μm. The heating roller 22 is a hollow roller of steel having an outer diameter of 10 mm, an inner diameter of 8 mm and a thickness of 1 mm. The fixing roller 23 is a high sliding property elastic roller comprising a core metal of ferro-alloy having an outer diameter of 10 mm and an inner diameter of 8 mm and a silicone rubber layer (elastic layer).

The diameters of the heating roller 22 and the fixing roller 23 are downsized since then the quick start property is assured by reducing the thermal capacity of the fixing device. The low thermal capacity of the members contacted to the fixing belt 20 which is heated is preferable for the quick start property. In order to reduce the diameters of the heating roller 22 and the fixing roller 23, it is desired to enhance the flexibility of the fixing belt 20, and therefore, it is effective to reduce the thickness of the metal layer which is the base layer of the fixing belt 20, more particularly, it is preferable that thickness thereof is not more than 200 μm. However, when the thickness of the metal layer of the fixing belt 20 is small, the rigid of the belt is small, and therefore, the influence of the surface property of the pad or the like to which the inner surface of the belt is contacted. For example, when the fixing sliding sheet 29 is processed by an emboss treatment, the pressure unevenness tends to occur, and therefore, the non-uniform-glossiness stripe tends to appear on the resultant image.

However, deep unevenness is proved on the surface of the pressing sliding sheet 30 contacted to the inner surface of the belt, by which the sliding resistance is reduced. Since the surface of the fixing sliding sheet 29 to which the inner surface of the belt is contacted is smooth, the non-uniform-glossiness stripe is not produced even if the thickness of the metal layer of the fixing belt is reduced.

Therefore, while the non-uniform-glossiness stripe is prevented from appearing on the resultant image, the proper belt travelling property and belt durable are assured. In addition, since the low thermal capacity of the fixing device is accomplished, the fixing non-uniformity is prevented with the enhanced quick start property.

Embodiment 5

Figure 3:
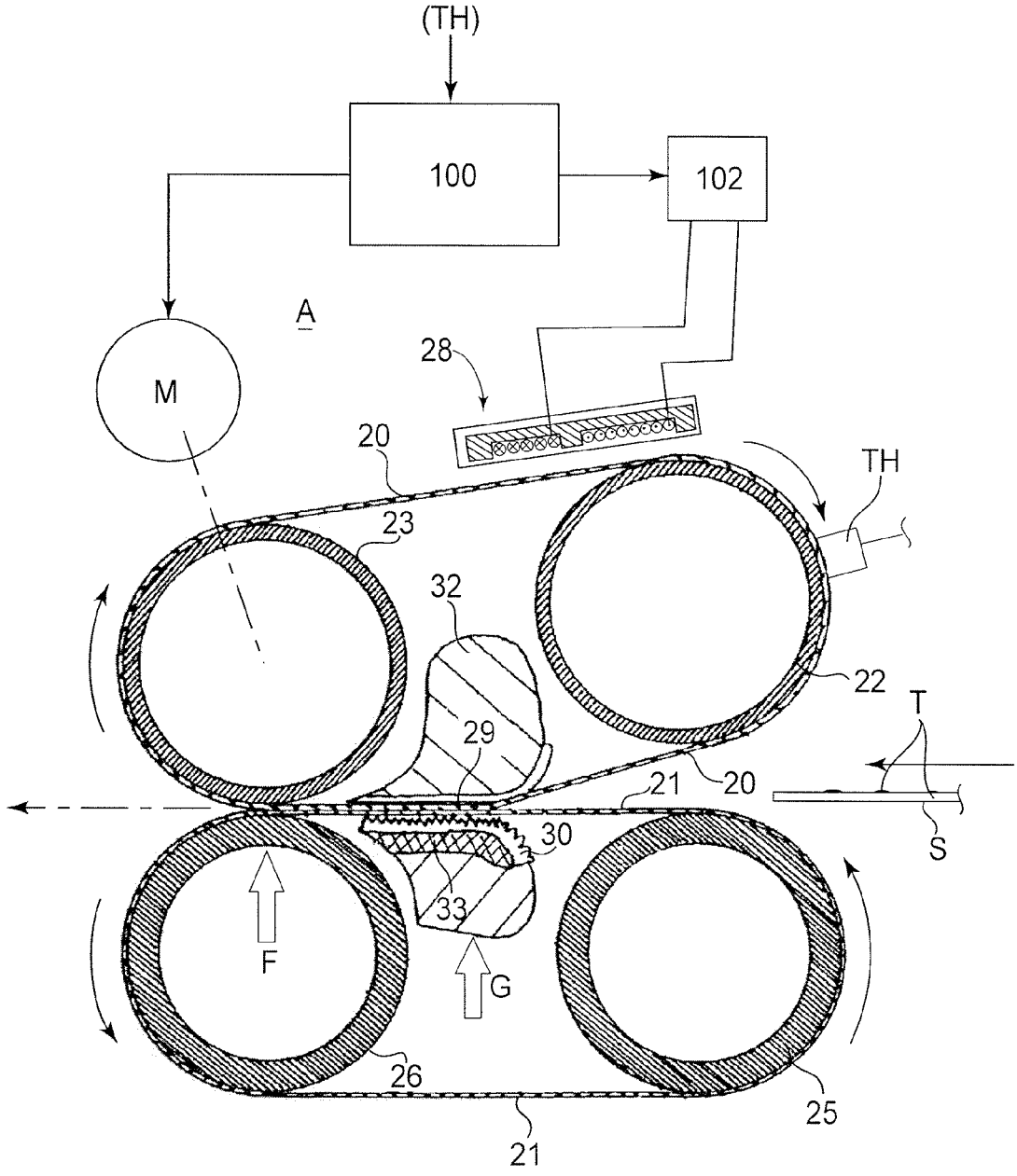
FIG. 3 is a schematic sectional view of a major part of a fixing device according to a fifth embodiment of the present invention.

FIG. 3 is a schematic sectional view of a major part of the fixing device A according to Embodiment 5 of the present invention. In this embodiment, the base member of the fixing pad 32 is a rigid member of ferro-alloy. The base member of the pressing pad 33 is made of heat resistive silicone rubber (elastic member) having a thickness of 3 mm, a width of 12 mm. The structures of the apparatus of this embodiment are the same as those of Embodiment 2 in the other respects.

When a nip is formed by pads, one of which is a rigid member which does not deform, the position of the nip plane is fixed. The other one of the pads is made of an elastic member so that it can follow the shape of the rigid pad. By doing so, the pressure distribution in the image heating nip can be made proper. Therefore, the image defect such as glossiness non-uniformity or the like attributable to the improper pressure distribution in the image heating nip can be prevented. However, if there is provided a sliding sheet having deep unevenness between the inner sliding surface of the belt having a base layer of metal and the rigid member pad, and that pressure difference within the nip due to the unevenness tends to be significantly large. In addition, a high-pressure is imparted at the projection portions of the unevenness of the sliding sheet in addition to the appearance of the stripes on the resultant image. When the apparatus is used for a long-term, the projection portions are scraped or collapsed with the result of list deep unevenness. When the surface of the sliding sheet is provided with a surface parting layer coating, the coating layer may be peeled off by which the sliding resistance increases with the result that image deviation, gear damage, electric energy consumption increase and other problems may arise. When a sliding sheet which is smooth or which has a shallow unevenness is provided between the belt and the pad of elastic member such as rubber, the contactness between the belt and the sliding sheet is so good that sliding sheet tends to stick to the belt. If this occurs, the sliding resistance at the time of starting up operation becomes large, with the result of problems such as gear damage or electric energy consumption increase for the driving motor and so on.

In view of these factors, according to the present invention, the base member of the fixing pad 32 which is contacted to the fixing sliding sheet 29 having a smooth sliding sheet in consideration of the influence to the image, is made of rigid member. And, the base member of the pressing pad 33 which is contacted to the pressing sliding sheet 30 and which can be provided with deep unevenness in consideration of the less influence to the image is made of elastic material.

In this manner, while the image defects such as the non-uniform-glossiness stripe, glossiness non-uniformity or the like can be prevented, the problems attributable to an increased shock resistance due to the long-term use or at the time of starting can be avoided, the problems including the image deviation, the gear damage, the electric energy consumption increase of the driving motor.

The surface roughness Rz and Sm of the pad or the sheet described in the foregoing were measured by a contact type surface roughness meter, SURFCODER SE-3400 available from Kabushiki Kaisha Kosaka Kenkyusho, Japan. The measuring condition is a cut off value of 0.8 mm, a measuring length of 8 mm and a feeding speed of 0.1 mm/sec. Here, Rz is a ten point average roughness defined in JIS B0601, and is qualitatively a level difference between the peak and valley.

And, Sm is an average interval between the peaks in accordance with JIS B0601.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 265873/2005 filed Sep. 13, 2005 which is hereby incorporated by reference.

What is claimed is:

1. An image heating apparatus comprising:

a first belt contactable to an image on a recording material to heat the image;

a second belt for forming a nip with said first belt;

a first pressing pad for pressing said first belt in said nip;

a second pressing pad for pressing said second belt toward said first pressing pad, wherein said first pressing pad has a surface roughness Rz of not more than 20 μm, and said second pressing pad has a surface roughness Rz of 50-300 μm.

2. An apparatus according to claim 1, wherein said first pressing pad includes a first base member and a first sheet which covers said first base member and which is slidable relative to said first belt, and said second pressing pad includes a second base member and a second sheet which covers said second base member and which is slidable relative to said second belt, wherein said first sheet has a surface roughness Rz of not more than 20 μm, and said second sheet has a surface roughness Rz of not less than 50 μm and not more than 300 μm.

3. An apparatus according to claim 2, wherein said first base member is a rigid member, and said second base member is an elastic member.

4. An apparatus according to claim 2, wherein said second sheet has an average peak interval Sm of not less than 250 μm and not more than 3000 μm.

5. An apparatus according to claim 1, wherein said second pressing pad has an average peak interval Sm of not less than 250 μm and not more than 3000 μm.

* * * * *